US007215234B2

(12) United States Patent
Hsu et al.

(10) Patent No.: US 7,215,234 B2
(45) Date of Patent: May 8, 2007

(54) TAP-OFF TRANSFORMER

(75) Inventors: Cheng-Chia Hsu, Chupei (TW); Teng-Kang Chang, Jhudong Township, Hsinchu County (TW)

(73) Assignee: Logan Technology Corp., Hsinchu (TW)

( * ) Notice: Subject to any disclaimer, the term of this patent is extended or adjusted under 35 U.S.C. 154(b) by 97 days.

(21) Appl. No.: 11/211,446

(22) Filed: Aug. 26, 2005

(65) Prior Publication Data

US 2006/0091988 A1 May 4, 2006

(30) Foreign Application Priority Data

Nov. 3, 2004 (TW) ..... 93217543 U

(51) Int. Cl.
*H01F 27/24* (2006.01)
*H01F 27/30* (2006.01)

(52) U.S. Cl. ..... 336/208; 336/212; 336/198

(58) Field of Classification Search ..... 336/212, 336/208, 198, 192; 242/388, 388.6, 388.91, 242/118, 600; 29/605–606, 602.1
See application file for complete search history.

(56) References Cited

U.S. PATENT DOCUMENTS 4,774,756 A * 10/1988 Dethienne ..... 29/605
4,904,975 A * 2/1990 Medenbach ..... 336/192
6,937,129 B2 * 8/2005 Hsueh et al. ..... 336/208
2003/0038696 A1 * 2/2003 Chui et al. ..... 336/198
2005/0219029 A1 * 10/2005 Watanabe et al. ..... 336/208

FOREIGN PATENT DOCUMENTS

JP 05304034 A * 11/1993

* cited by examiner

*Primary Examiner*—Anh Mai

(57) ABSTRACT

A tap-off transformer includes a coil base, a core and wires. The coil base has isolating walls placed outside and using isolating walls to form a first winding slot on a primary side area and a plurality of second winding slots on a secondary side area. Different kinds of wires could be winded inside the first and second winding slots. A wiring start point inside the plurality of second winding slots on the secondary side area is placed on one of the isolating walls, with coils starting from the start point to extend outwards to either sides of the secondary side area and ending at either sides. The coil base has a hollow structure for placing the core to form a transformer structure. The present invention provides isolating walls and a winding design to increase a rated voltage of the transformer and to improve the stability of the transformer.

4 Claims, 3 Drawing Sheets

TAP-OFF TRANSFORMER

BACKGROUND OF THE INVENTION

1. Field of the Invention

The present invention relates to a tap-off transformer, and more particularly, to a tap-off transformer using isolating walls and a winding design to increase the rated voltage of transformer.

2. Description of the Prior Art

FIG. 1A is a cross sectional side view and FIG. 1B is a side view of the windings of a conventional transformer. Referring to the figures, the transformer 1 comprises a coil base 11, a core 12 and wires 13. The coil base 11 has isolating walls 111 placed outside of it and using isolating walls 111 to form a primary side area 14 and a secondary side area 15. The secondary side area 15 is partitioned into a plurality of winding slots 16 by isolating walls 111 with wires 13 being winded sequentially in winding slots 16. The coil base 11 has hollow structure for placing core 12 to form transformer 1. The above mentioned transformer structure uses isolating walls to set up a winding slot in primary side area and a plurality of winding slots in secondary side area with wires winded sequentially and unidirectionally inside winding slots to achieve the required rated voltage of the transformer. Hence, the secondary side area (~0V-Vout) uses multiple winding slots to provide voltage isolation, however, since voltage of every isolated slot could be varied and it tends to result in over voltage between slots, thus the characteristics of component will become unstable to cause abnormal function of the product.

Therefore, the prior art transformer mentioned above presents several shortcomings to be overcome.

In view of the above-described deficiency of prior-art transformers, after years of constant effort in research, the inventor of this invention has consequently developed and proposed a tap-off transformer.

SUMMARY OF THE INVENTION

The present invention is to provide a tap-off transformer, using isolating walls and a winding design to increase the rated voltage of transformer.

Another, the present invention is to provide a tap-off transformer having advantages such as higher stability, longer lifetime, lower product cost, smaller transformer size and space saving capabilities.

A tap-off transformer of the present invention comprises a coil base, a core and wires. The coil base has isolating walls placed outside of it and using isolating walls to form a winding slot on a primary side area and a plurality of winding slots on a secondary side area Different kinds of wires could be winded inside the plurality of winding slots. A wiring start point inside the plurality of winding slots in the secondary side area is placed on one of the isolating walls in the secondary side area, with coils starting from the start point to extend outwards to either sides of the secondary side area and ending at either sides to form two voltage segments. The coil base has a hollow structure for placing the core to form a transformer structure.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
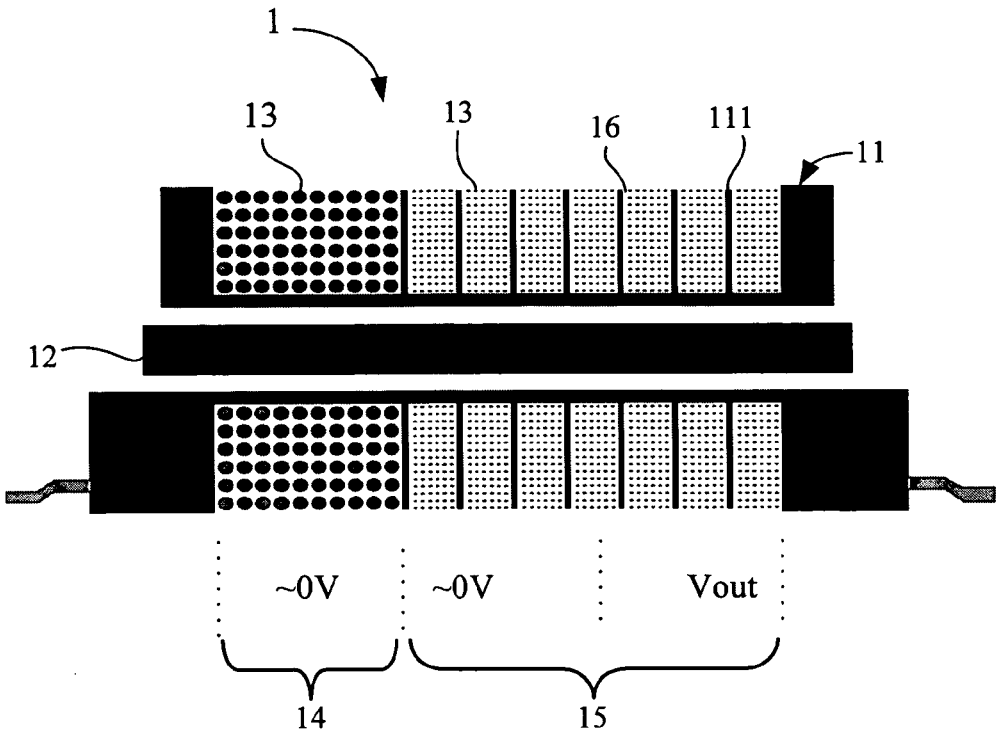
PRIOR ART FIG.1 A
FIG. 1A is a cross sectional side view of a conventional transformer.
Figure 1B:
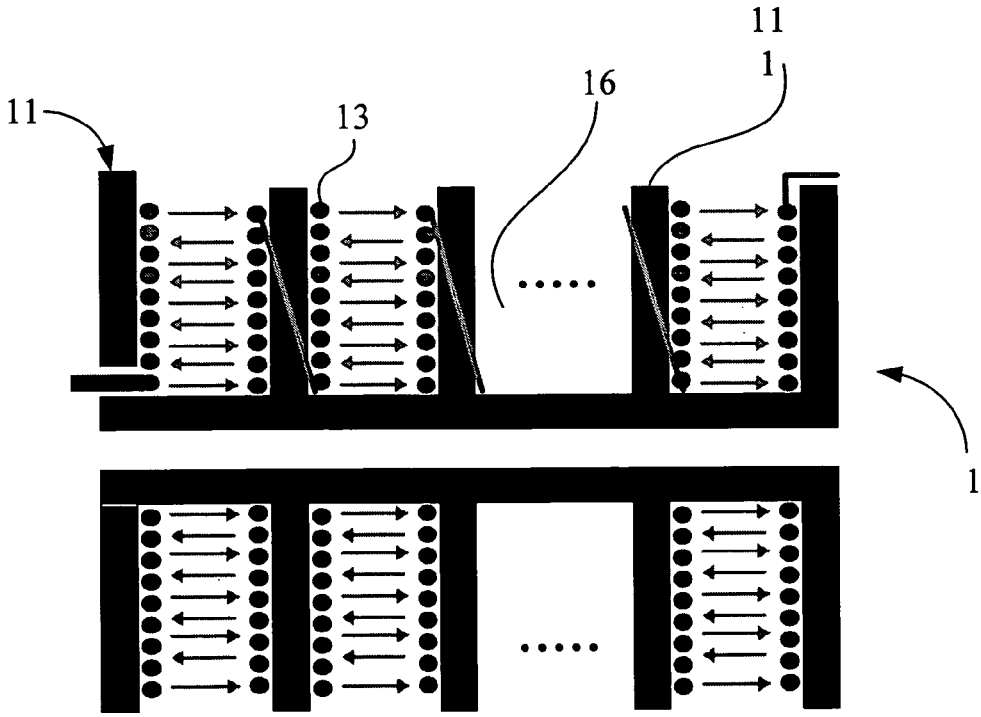
FIG.1 B PRIOR ART
FIG. 1B is a side view of the windings of a conventional transformer.
Figure 2A:
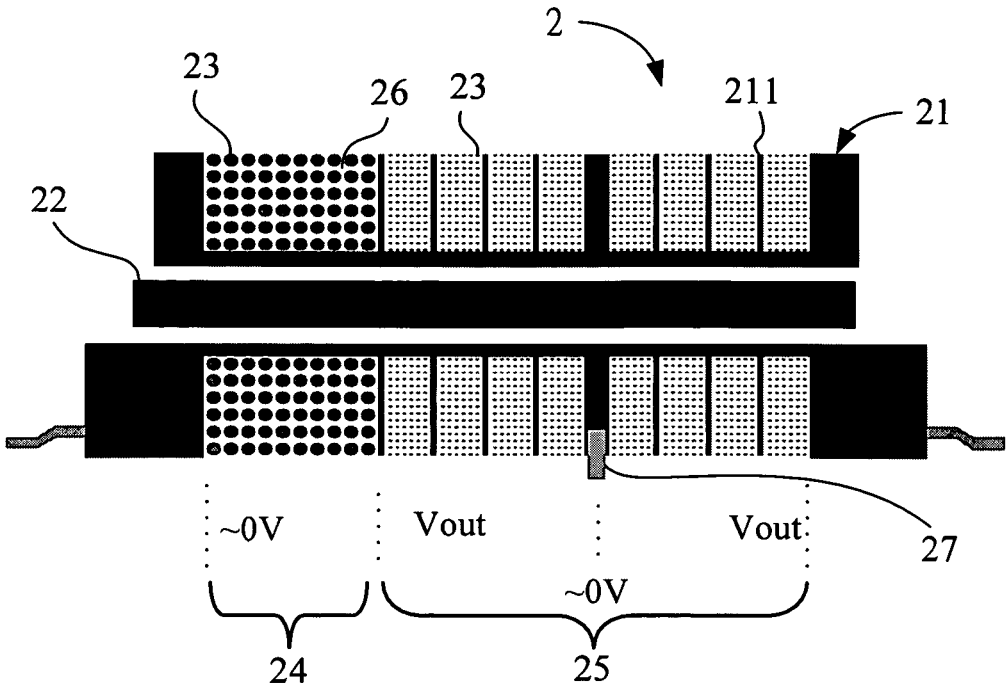
FIG. 2A is a cross sectional side view of a tap-off transformer in the present invention.
Figure 2B:
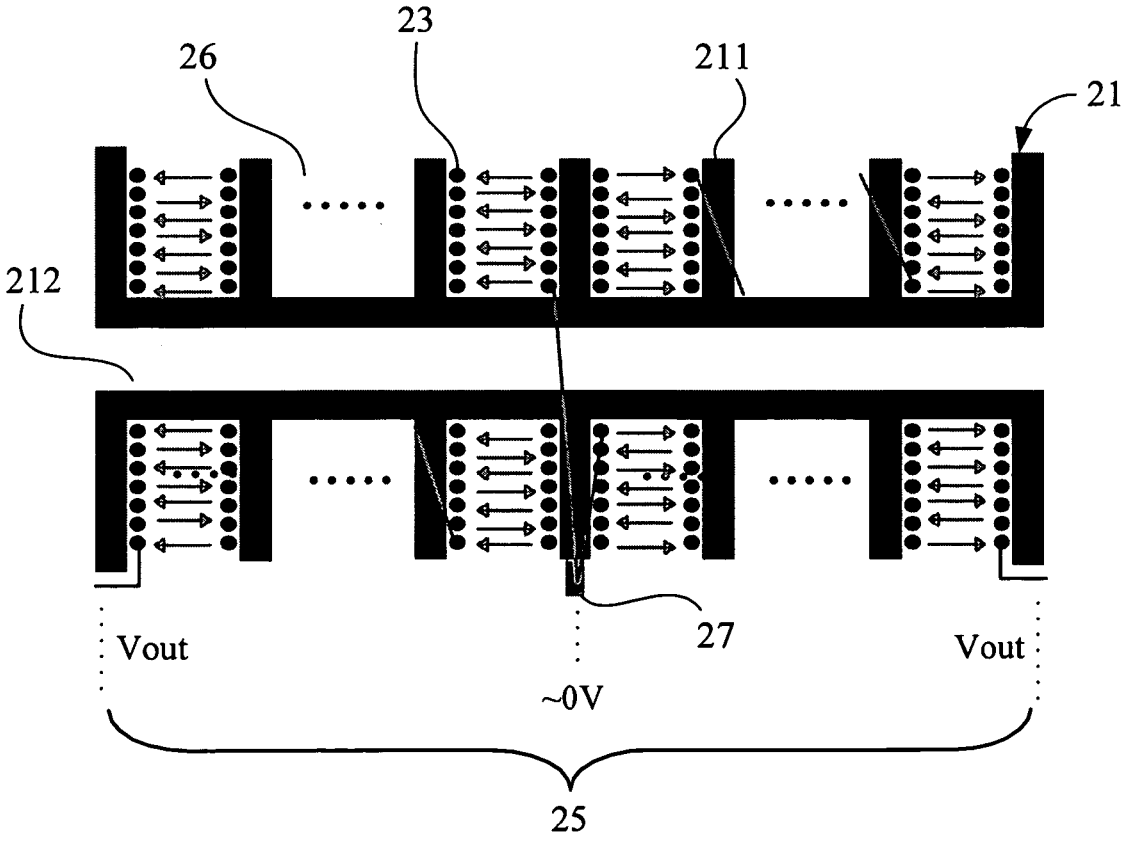
FIG. 2B is a side view of the windings of the tap-off transformer.

FIG. 2A is a cross sectional side view and FIG. 2B is a side view of the windings of the tap-off transformer in the present invention. Referring to these figures, the tap-off transformer 2 disclosed in the present invention comprises a coil base 21, a core 22 and wires 23. The coil base 21 has isolating walls 211 placed outside of it and using isolating walls 211 to form a primary side area 24 and a secondary side area 25. A plurality of winding slots 26 are set up in primary side area 24 and secondary side area 25. Different kinds of wires 23 could be winded inside the plurality of winding slots. A wiring start point 27 inside the plurality of winding slots 26 in secondary side area 25 is placed on one of the isolating walls 211 in secondary side area 25, with coils starting from start point 27 to extend outwards to either sides of secondary side area 25 and ending at either sides to form two voltage segments (Vout~0V and ~0V-Vout) to effectively increase the rated voltage of transformer. The coil base 21 has a hollow structure 212 for placing core 22 to form tap-off transformer 2. The present invention provides isolating walls and a winding design to increase the rated voltage of transformer and to improve the stability of transformer.

Figure 3:
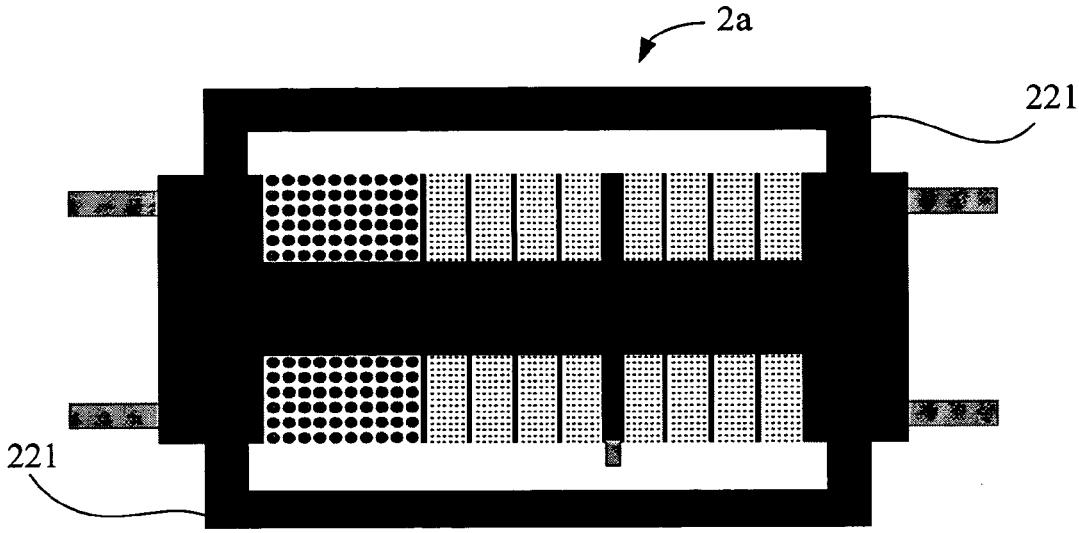
FIG. 3 is a diagram illustrating a first embodiment of the tap-off transformer.

FIG. 3 is a diagram illustrating a first embodiment of the tap-off transformer. The tap-off transformer 2*a* with high rated voltage adopts a core that is consisted of two E-shaped core 221.

Figure 4:
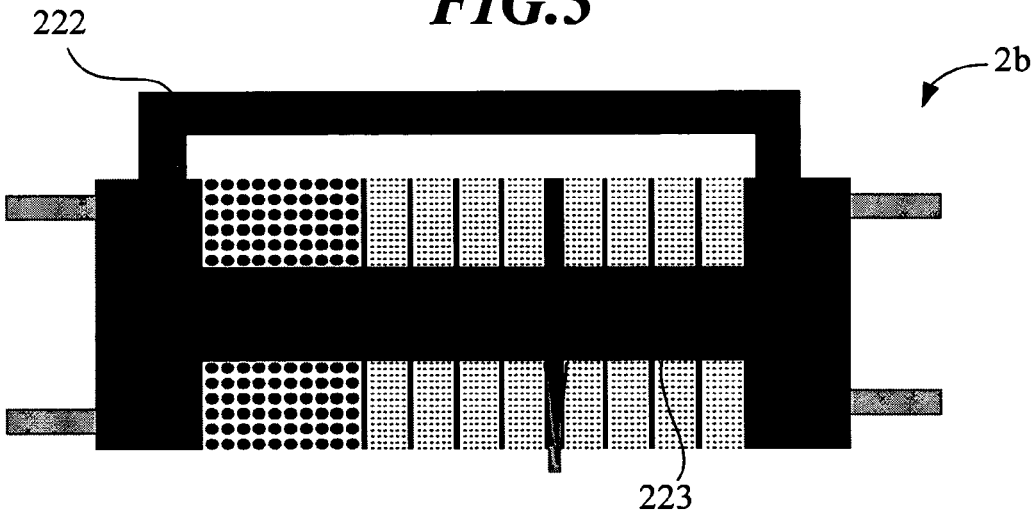
FIG. 4 is a diagram illustrating a second embodiment of the tap-off transformer.

FIG. 4 is a diagram illustrating a second embodiment of the tap-off transformer. The tap-off transformer 2*b* with high rated voltage adopts a core that is consisted of a C-shaped core 222 and a I-shaped core 223.

Figure 5:
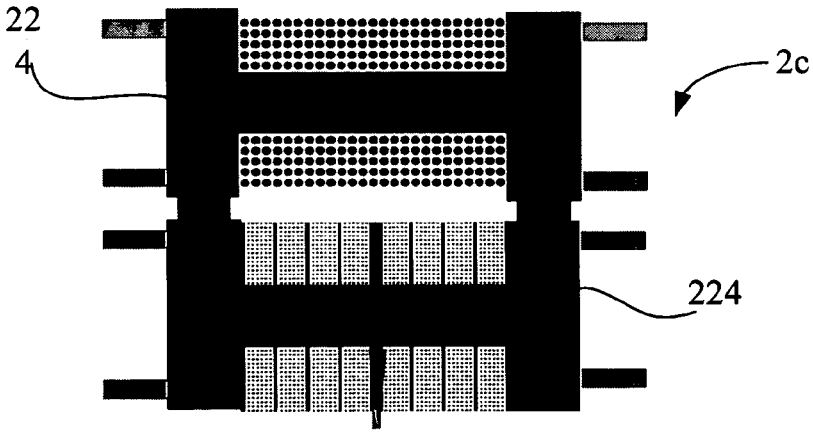
FIG. 5 is a diagram illustrating a third embodiment of the tap-off transformer.

FIG. 5 is a diagram illustrating a third embodiment of the tap-off transformer. The tap-off transformer 2*c* with high rated voltage adopts a core that is consisted of two U-shaped core 224.

The present invention provides a tap-off transformer, which compared with other prior art transformers, is advantageous in:

The present invention provides a tap-off transformer, using isolating walls and a winding design to increase the rated voltage of transformer.

The present invention provides a tap-off transformer having advantages such as higher stability, longer lifetime, lower product cost, smaller transformer size and space saving capabilities.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A tap-off transformer comprising:

a core and wires; and a coil base having isolating walls placed outside thereof and using isolating walls to form a primary side area and a secondary side area, a plurality of winding slots set up in primary side area and the secondary side area, wherein different kinds of wires are wound inside the plurality of winding slots, a wiring start point inside the plurality of winding slots in the secondary side area being placed on one of the isolating walls in the secondary side area, with coils starting from the start point to extend outwards to either sides of the secondary side area and ending at either sides to form two voltage segments, the coil base having a hollow structure for placing the core to form the tap-off transformer.

2. The tap-off transformer of claim 1 wherein the core comprises two E-shaped cores.

3. The tap-off transformer of claim 1 wherein the core comprises a C-shaped core and an I-shaped core.

4. The tap-off transformer of claim 1 wherein the core comprises two U-shaped cores.

* * * * *

UNITED STATES PATENT AND TRADEMARK OFFICE

CERTIFICATE OF CORRECTION

PATENT NO. : 7,215,234 B2
APPLICATION NO. : 11/211446
DATED : May 8, 2007
INVENTOR(S) : Cheng-Chia Hsu It is certified that error appears in the above-identified patent and that said Letters Patent is hereby corrected as shown below:

On the Title Page, Item (73)
The assignee should be --Logah Technology Corp.-- instead of "Logan Technology Corp.".

Signed and Sealed this

Second Day of December, 2008

JON W. DUDAS
*Director of the United States Patent and Trademark Office*